US007199315B1

(12) United States Patent
Sharrah et al.

(10) Patent No.: US 7,199,315 B1
(45) Date of Patent: Apr. 3, 2007

(54) PRESSURE ACTUATED ELECTRICAL SWITCH

(75) Inventors: Raymond L. Sharrah, Collegeville, PA (US); Charles W. Craft, Landsdale, PA (US); John C. DiNenna, Bridgeport, PA (US)

(73) Assignee: Streamlight, Inc., Eagleville, PA (US)

( * ) Notice: Subject to any disclaimer, the term of this patent is extended or adjusted under 35 U.S.C. 154(b) by 205 days.

(21) Appl. No.: 11/044,954

(22) Filed: Jan. 27, 2005

Related U.S. Application Data

(60) Provisional application No. 60/542,027, filed on Feb. 5, 2004.

(51) Int. Cl.
*H01H 3/16* (2006.01)

(52) U.S. Cl. ..... 200/61.43; 200/61.73; 200/85 R; 200/511

(58) Field of Classification Search ..... 200/17 R, 200/18, 52 R, 61.41–61.44, 61.62, 61.71, 200/61.73, 61.74, 61.76, 61.78, 61.81, 61.82, 200/406, 511, 512, 516, 85 R, 86 R, 86 A; 49/26–28; 180/271, 274; 280/734, 735
See application file for complete search history.

(56) References Cited

U.S. PATENT DOCUMENTS 2,938,977 A 5/1960 Koenig
3,052,772 A 9/1962 Koenig
3,710,054 A 1/1973 Koenig
4,273,974 A * 6/1981 Miller ..... 200/61.43
4,293,751 A 10/1981 Van Benthuysen et al.
4,293,752 A * 10/1981 Koenig ..... 200/295
4,551,595 A 11/1985 Koenig et al.
4,987,277 A * 1/1991 Duhon ..... 200/86 R
5,628,555 A 5/1997 Sharrah et al.
5,680,909 A * 10/1997 Lofy ..... 180/274
5,723,835 A * 3/1998 Gilmore ..... 200/61.71
5,913,669 A 6/1999 Hansen et al.
5,939,687 A * 8/1999 Ellermann ..... 200/61.58 R

OTHER PUBLICATIONS

Insight Technology, Inc., "Insight Technology—Accessories", http://www.insightlights.com/accessories/default.asp, Printed Oct. 28, 2004, 7 Pages.
Insight Technology, Inc., "M6X Tactical Laser Illuminator," http://www.insightlights.com/products/showProduct.asp?id=11, Printed Oct. 28, 2004, 3 Pages.
Laird Technologies, "Finger Gaskets Symmetrical Slotted Shielding (S3)," http:/www.lairdtech.com/scripts/cgiip.exe/WService-=w3DevCat/1_product.html?lnk=pg6, Printed Jan. 23, 2004, 5 Pages.
Snaptron Inc., "Metal domes for membrane and momentary switch contacts," http://www.snaptron.com/metaldomes.cfm, Copyright 2003-2004, Printed Jan. 4, 2005, 6 Pages.

(Continued)

*Primary Examiner*—Michael A Friedhofer
(74) *Attorney, Agent, or Firm*—Clement A. Berard; Dann, Dorfman, Herrell and Skillman

(57) ABSTRACT

An electrical switch comprises a dielectric substrate and a deformable contact member overlying the dielectric substrate for contacting an electrical conductor on the dielectric substrate when deformed. The contact member is electrically connected to another electrical conductor on the dielectric substrate, and may have plural contact fingers. A mounting may be provided for mounting the switch using a fastener, a tie member or an adhesive member.

31 Claims, 9 Drawing Sheets

OTHER PUBLICATIONS

TANGODOWN LLC, "Products," http://www.tangodownllc.com/products.shtml, Copyright 2003, Printed Jan. 4, 2005, 3 Pages.

Steady Flying Enterprise Co., Ltd., "Just Light Flashlight, Package and Product," Date Unknown, 4 Pages.

* cited by examiner

FIGURE 4A
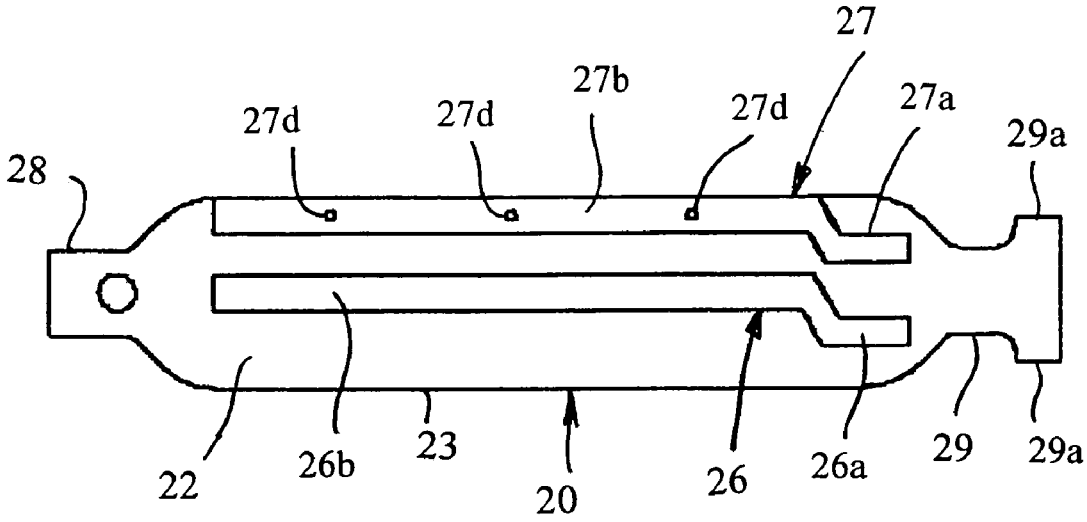
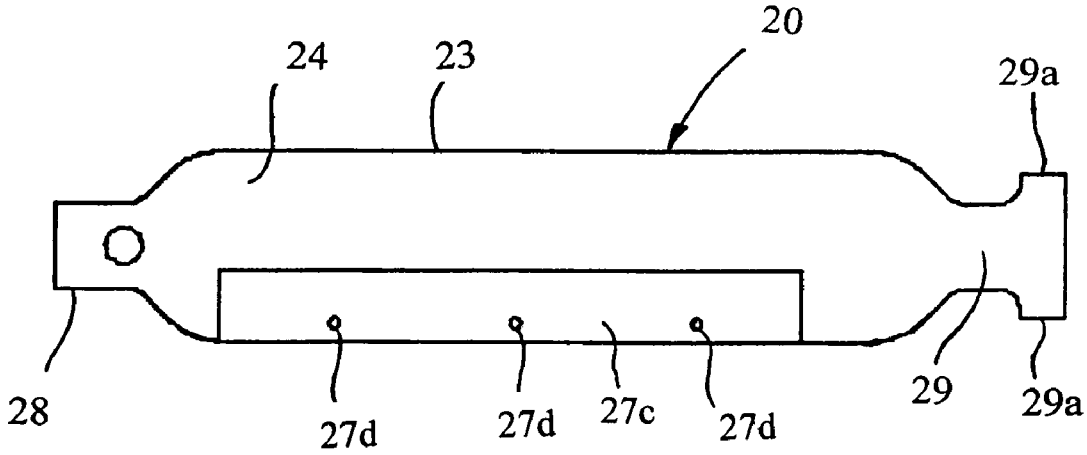
FIGURE 4B

PRESSURE ACTUATED ELECTRICAL SWITCH

This Application claims the benefit of U.S. Provisional Patent Application No. 60/542,027 filed on Feb. 5, 2004.

The present invention relates to an electrical switch and, in particular, to a electrical switch actuated by pressure.

Tape and/or ribbon switches are known in the art, and have been utilized as actuators or controllers in a wide variety of applications including, e.g., operating machinery and equipment, simple remote control of lights, annunciators and doors, and detectors for burglar and other alarms.

For example, U.S. Pat. No. 2,938,977 describes an electric switching mat including flexible upper and lower contact strips that are separated by insulating strips and that are brought into contact by pressure on the mat;

U.S. Pat. No. 3,710,054 describes ribbon switching means having first and second conductive strips separated by insulated members which are edge mounted in staggered space relationship;

U.S. Pat. No. 4,551,595 describes a tape switch with a corrugated wavy conductor that is spaced away from and contacts another conductive strip when pressed; and U.S. Pat. No. 5,913,669 describes an aiming light mount and system for a shotgun wherein a tape switch is located on the hand grip of the shotgun.

Where the electrical switch is actuated by pressure applied by a human operator, it is helpful and/or important in certain applications that the human operator have a definite tactile sense of where the switch is and where it is to be pressed. This need arises where the operator might be wearing gloves or where the switch is out of the operator's field of vision when it is to be actuated. Examples of such applications might include a switch mounted to a weapon for actuating a light, a night-vision device or other electrical or electronic device aiding the operator.

In addition, where the electrical switch is mounted to a weapon, for example, different mounting arrangements are found on weapons from different manufacturers and even on different weapons from the same manufacturer. Even accessories intended for mounting with a so-called "standard" mounts are often not compatible with so-called "standard" mounts from different manufacturers. Further, many weapons and other devices lack a mount suitable adapted to receive a pressure actuated switch.

Conventionally, switches are often mounted to weapons by an adhesive, such as a double-sided adhesive tape or by a hook and loop (e.g., Velcro®) fastener that is itself attached to the weapon and to the switch by adhesive. Under adverse conditions, such as in very high temperature environments such as a jungle or a dessert, adhesives may lose their adhesion and the switch may move or come apart from the weapon. This problem is compounded by many substances ordinarily used where weapons are used, such as gun oil, sun screen liquids and insect repellants. These substances often degrade the adhesion of an adhesive or render it incapable of adhering to a surface that has one of these common substances, and may even by a solvent for the adhesive. In any case, the adhesive fails to properly adhere the switch to the weapon.

Accordingly, there is a need for a pressure-actuated switch that is adapted for mounting to various weapons or other devices in different ways. Further, there is a need for a pressure-actuated switch that is arranged to define a region to be pressed that may be located by touch. It would also be desirable that the switch be arranged for facilitating it being mounted to a weapon or other device or apparatus with which it may be utilized.

To this end, the electrical switch of the present arrangement comprises a dielectric substrate having on a first surface thereof a first electrical conductor near at least one edge thereof and having a second electrical conductor in a central region thereof; an arcuate flexible metal contact member juxtaposed to the first surface of the dielectric substrate, the arcuate flexible metal contact member having a first edge electrically connecting to the first electrical conductor of the dielectric substrate and having an arcuate central region overlying the second electrical conductor thereof for making electrical contact therewith when actuating force or pressure is applied to the arcuate flexible metal contact member; and mounting means to which the dielectric substrate and the arcuate flexible metal member are mounted, the mounting means comprising means for mounting the electrical switch to an object employing any one or more of a fastener, a tie member and an adhesive member.

According to another aspect, a metal member having a domed central region or having a plurality of deformable contact fingers overlies the dielectric substrate for contacting an electrical conductor on the dielectric substrate when deformed.

According to another aspect, the electrical switch comprises first and second end members each having a raised portion of a given height, and a switch member extending between and attached to the first and second end members and having a flexible contact member defining a ridge at a height less than the given height of the end members. An electrical conductor within the switch member is contacted by the flexible contact member when an actuating force is applied thereto.

BRIEF DESCRIPTION OF THE DRAWING

The detailed description of the preferred embodiments of the present arrangement will be more easily and better understood when read in conjunction with the FIGURES of the Drawing which include:

FIGS. 4A and 4B are plan views of the opposing sides of a dielectric substrate of the example switch embodiment of FIGS. 1, 2A, 2B and 2C;

Figure 1:
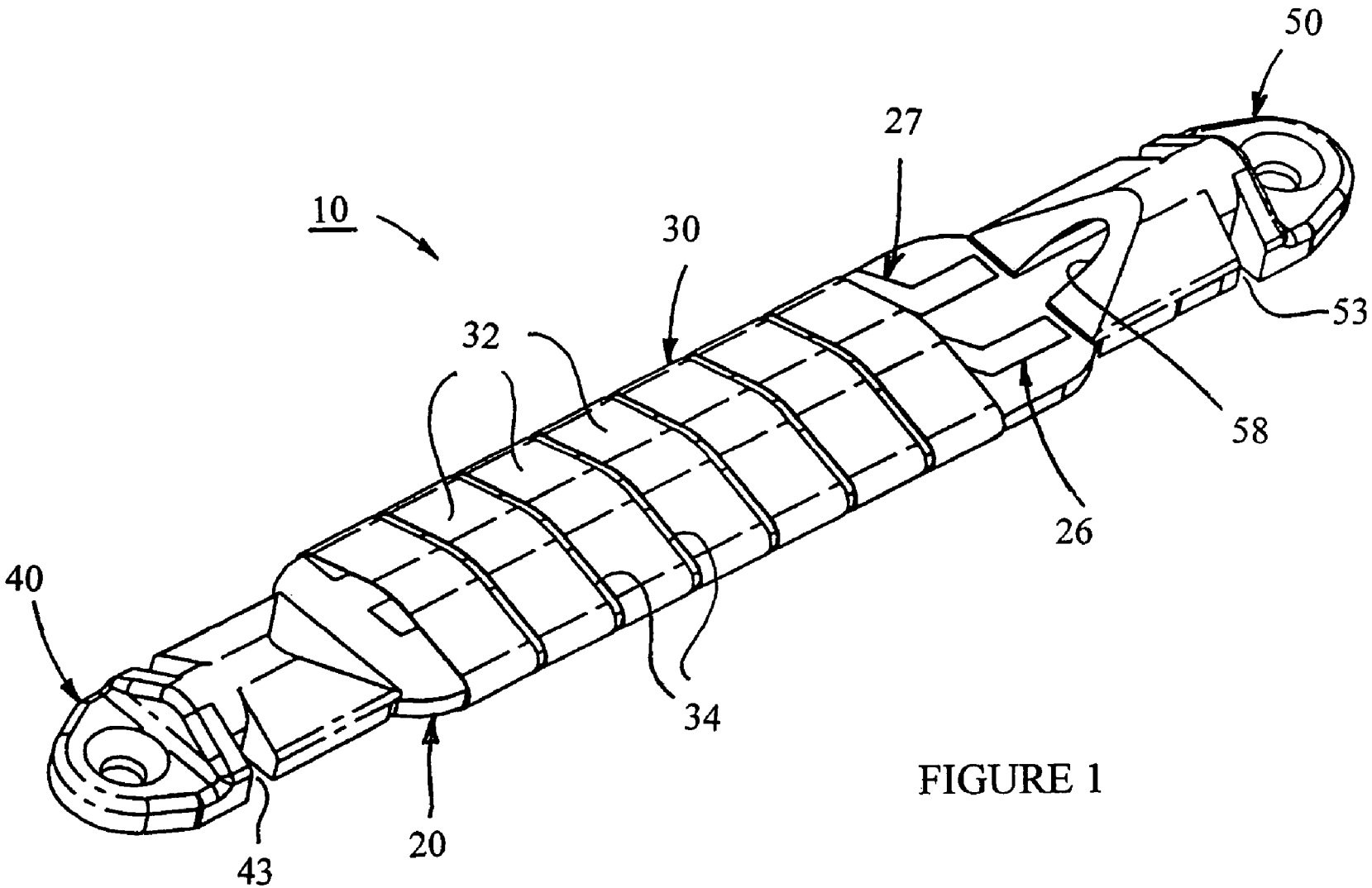
FIG. 1 is an isometric view of an example embodiment of a switch including the present arrangement.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification, or may be designated with a different series of numbers, e.g., 1xx, 2xx. It is noted that, according to common practice, the various features of the drawing are not to scale, and the dimensions of the various features are arbitrarily expanded or reduced for clarity.

DESCRIPTION OF THE PREFERRED EMBODIMENTS

FIG. 1 is an isometric view of an example embodiment of a switch 10 including the present arrangement. Switch 10 is an elongated switch having an elongate dielectric substrate 20 with end members or end pieces 40 and 50 at the opposite ends thereof. Metal switch element 30 is proximate dielectric substrate 20 and has a plurality of arcuate or dome-shaped springy or deformable contact fingers 32 defined by spaces or gaps 34 in metal contact member 30. As is described below, contact member 30 preferably is formed at its transverse ends so as to wrap around the edges of dielectric substrate 20.

Dielectric substrate 20 includes electrical conductors 26, 27 that extend along its length for selectively contacting contact member 30 when contact member 30 is pressed. Specifically, conductor 27 extends proximate the edge of dielectric substrate 20 whereat it makes electrical contact with one end of contact member 30 so as to be electrically connected to each of contact fingers 32. Conductor 26 extends longitudinally on dielectric substrate 20 so as to extend under the plurality of contact fingers 32 of contact member 30.

Absent actuating force or pressure being applied to contact fingers 32 to deform contact fingers 32, contact fingers 32 are spaced away from conductor 26 as a result of their being formed in an arcuate or dome-shape, and no electrical connection is made between conductors 26 and 27. When any one or more of the contact fingers 32 are pressed, they flex or bend or deform towards dielectric substrate 20 so as to come into electrical contact with conductor 26, thereby making electrical connection between conductors 26 and 27 until the actuating (deforming) force or pressure on contact fingers 32 is removed. Thus, electrical switching action is provided between conductors 26 and 27. In a typical application, electrical switching action is provided between the electrical lead wires connected to conductors 26 and 27.

End members or end pieces 40, 50 are fastened to opposite ends of dielectric substrate 20 and have respective holes 41, 51, among other features, which may be utilized for mounting switch 10 to an object. End members 40, 50 also have respective raised surfaces 44, 54 that are higher than are the arcuate portions of contact fingers 32, so as to define a region or valley between end members 40, 50 where pressure is to be applied to contact fingers 32 to actuate switch 10, thereby to provide a tactile indication to an operator as to where to press to actuate switch 10.

End member 50 also includes an opening or tunnel 58 through which electrical wires (not shown) may pass to connect to conductors 26, 27 of dielectric substrate 20. These electrical wires may be of any desired length and arrangement, e.g., two wires, two wires in a sheath, two wires twisted, a shielded twisted pair of wires, a plural conductor ribbon cable, a coaxial cable, a shielded wire or wires, a plural-wire cable, coiled wires or a coiled cord, and the like.

Preferably, switch 10 is enclosed within a flexible conforming sheath 60 that extends the distance between end members 40 and 50 for keeping dirt, water, and other debris and foreign matter from easily reaching switch contact elements 26, 27, 30. The flexible conforming sheath 60 is not shown in FIGS. 1 and 2A–2C so that the internal arrangement of switch 10 is exposed and visible, but is shown in the cross-sectional views of FIGS. 3A and 3B.

Figure 2A:
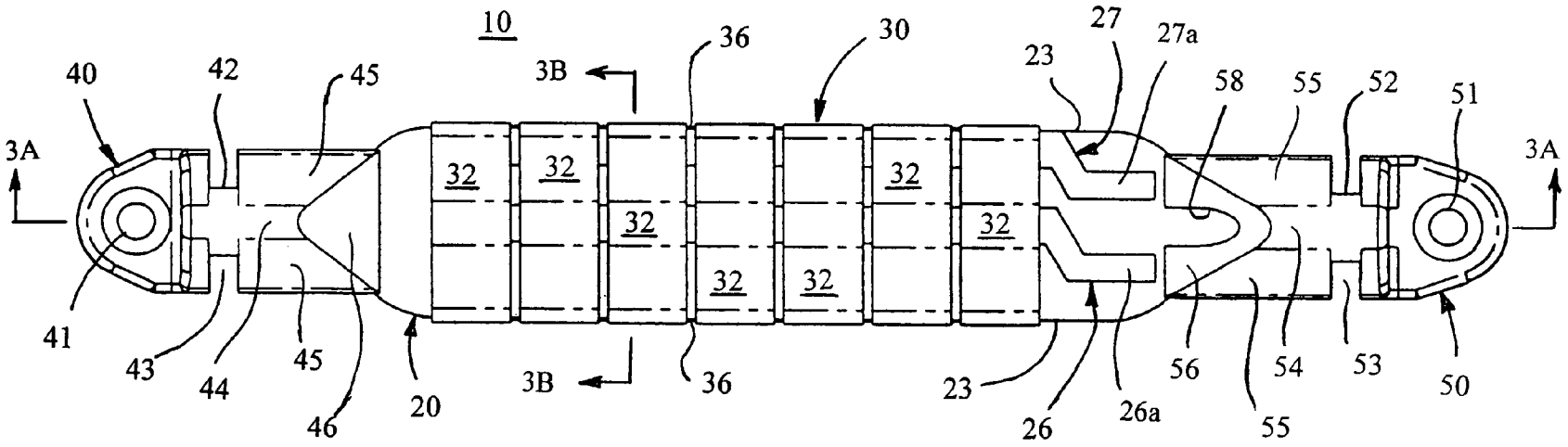
FIGS. 2A, 2B and 2C are top, side and bottom views, respectively, of the example switch embodiment of FIG. 1.
Figure 2B:
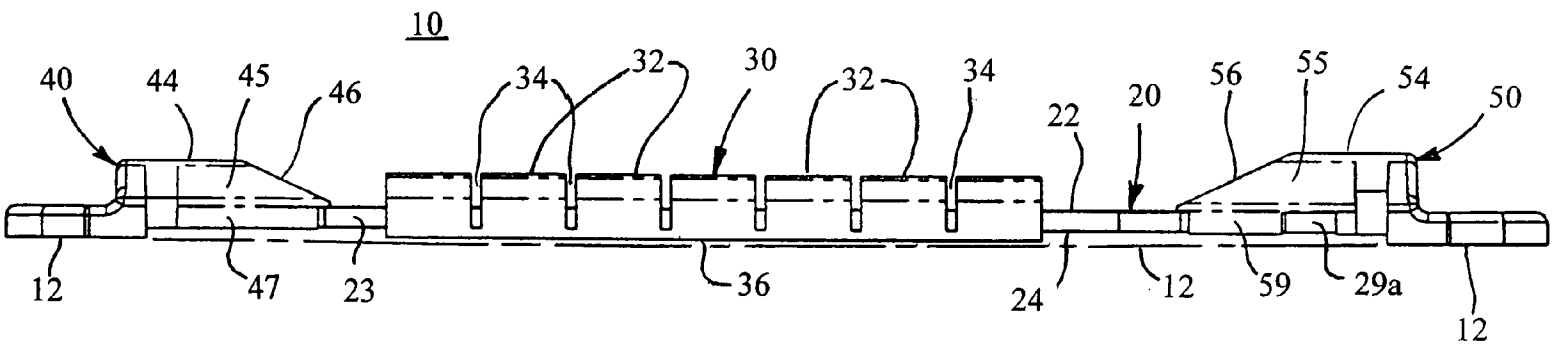
Figure 2C:
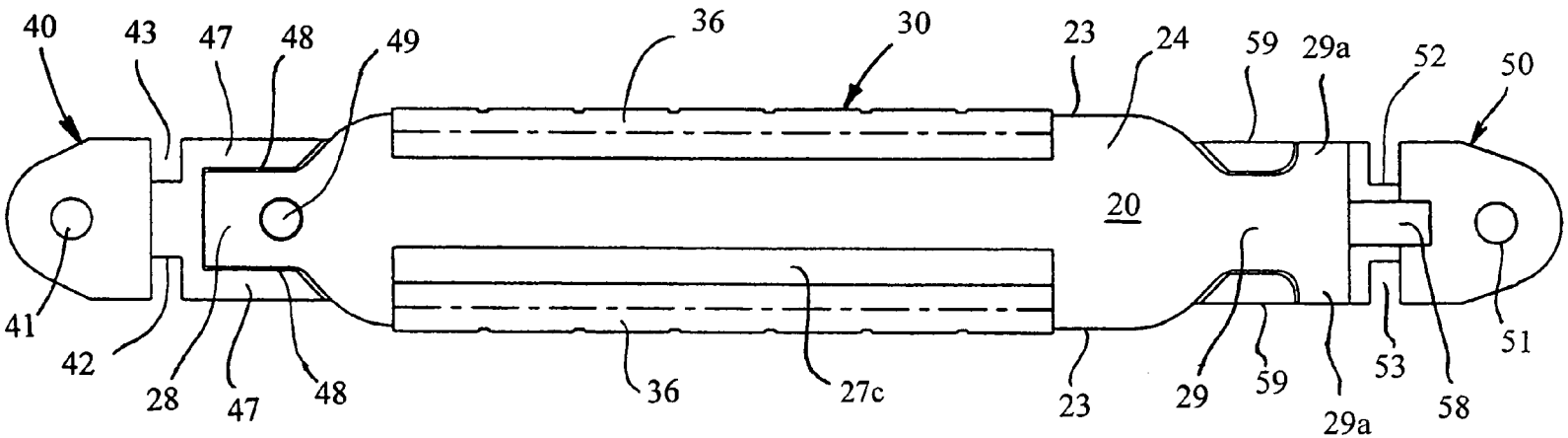
Figure 3A:
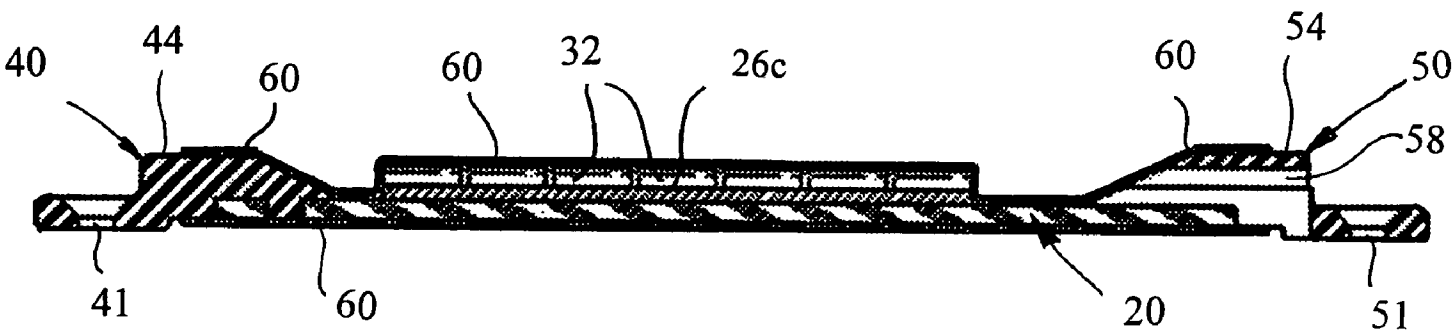
FIGS. 3A and 3B are longitudinal and transverse cross-sectional views, respectively, of the example switch embodiment of FIGS. 1, 2A, 2B and 2C.
Figure 3B:
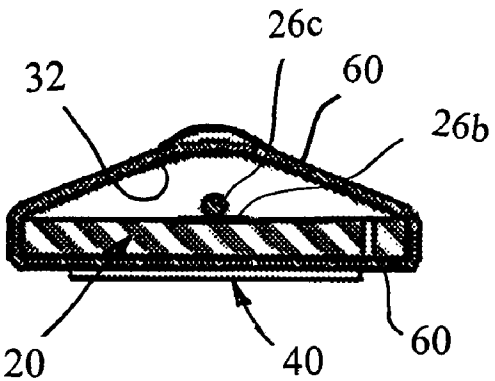

Example switch 10 is described in detail herein in relation to FIGS. 2A, 2B and 2C which are top, side and bottom views, respectively, of the example switch 10 embodiment of FIG. 1, and to FIGS. 3A and 3B which are longitudinal and transverse cross-sectional views, respectively, of the example switch 10 embodiment of FIGS. 1, 2A, 2B and 2C.

FIGS. 4A and 4B are plan views of the opposing sides 22, 24 of dielectric substrate 20 of the example switch 10 embodiment of FIGS. 1, 2A, 2B and 2C.

Central to switch 10 is dielectric substrate 20, e.g., a printed wiring electrical circuit board, having patterned electrical conductors 26 and 27 on surface 22 thereof for connecting to the metal switch element 30 and to provide locations proximate one end of circuit board 20 to which lead wires (not shown) may be connected, e.g., by soldering. Conductor 26 includes a portion 26*a* that extends generally lengthwise along a central region of surface 22 of circuit board 20 and conductor 27 includes a portion 27*b* that extends generally lengthwise proximate one edge 23 of surface 22 thereof. Each of conductors 26, 27 may have a connection site 26*a*, 27*a*, respectively, at which electrical lead wires may be connected, e.g., by soldering, welding, or conductive adhesive.

Circuit board 20 may also have a portion of conductor 27 identified as conductor 27*c* extending generally lengthwise on surface 24 along the same edge 23 of circuit board 20 as does conductor 27*b*. Conductors 27*b* and 27*c* are electrically connected, e.g., by one or more plated-through holes or conductive vias 27*d* between surfaces 22 and 24, or by a conductive path over edge 23 between surfaces 22 and 24. Circuit board 20 is typically made from a copper-clad epoxy-glass circuit board material or from a copper-clad FR4 material or from a copper-clad phenolic circuit board material, but may be of other suitable materials, such as ceramic or polyimide. Conductors 26, 27, and plated holes/vias 27*d*, are applied, patterned, etched and/or otherwise made in conventional manner.

Preferably, conductor 26 extends lengthwise along surface 22 of circuit board 20 a sufficient distance to underlie all of contact fingers 32 of contact member 30 when switch 10 is assembled. While printed circuit conductor 26 on circuit board 20 is sufficient for proper operation of switch 10, conductor 26 may be raised or elevated above the surface 22 of circuit board 20 so as to provide a contact region closer to, but spaced apart from, contact fingers 32 than is surface 22 of circuit board 20. Typically, a length of electrically conductive material, e.g., of a bare wire or rod or bar 26*c* of copper or brass, may be soldered along the portion of conductor 26 that underlies contact fingers 32. Optionally, elevating conductor 26*c* may be tinned, coated or plated so as to decrease the likelihood of oxidation and may also serve to increase the conductivity and current carrying capacity of conductor 26.

Metal contact member 30 is typically stamped from a flat sheet of springy electrically conductive metal and then formed into a "C" shape. For example, member 30 may be stamped as a generally rectangularly shaped piece having a number of generally parallel slots 34 therein to define a plurality of contact fingers 32. Preferably, slots 34 extend near to the opposing edges 36 of contact member 30, but do not extend all the way to either edge 36, and so slots 34 are closed and a continuous edge 36 remains at opposing edges of contact member 30.

Metal contact members 30 is formed into a generally "C" shaped form with continuous edges 36 at the remote ends of the "C" and with contact fingers 32 having a curved or domed shape so as to be spaced away from the surface of circuit board 20 when placed thereon. Contact member 30 is formed or folded in the region proximate continuous edges 36 to be of a shape and dimension to receive circuit board 20 lengthwise thereat. Contact member 30 may be of beryllium copper, stainless steel, phosphor bronze, copper-clad spring steel, springy brass or other suitable conductive material, and may be plated, e.g., with sulfamate nickel or other suitable plating.

It is noted that the arcuate contact member 30 may be formed have a curved shape, a domed shape, a segmented folded shape, or any other arcuate shape, the particular shape being immaterial so long as contact fingers are spaced apart from conductor 26 of circuit board 20 and are deformable by actuating force to contact conductor 26 thereof. In general, a relatively definite fold is desirable at continuous edges 36 for approximately conforming to the edge shape of circuit board 20. Typically, contact member 30 is available in a given size and the width and length of circuit board 20 are selected to be compatible therewith.

One suitable material for contact member 30 is symmetrical slotted shielding (S3) type of finger stock RF shielding gasket available from Laird Technologies, formerly Instrument Specialties Company, which has an office in Delaware Water Gap, Pa. This shielding gasket may be obtained in a relatively long length and be cut into segments that include the desired number of contact fingers 32.

Contact member 30 may provide any desired number of contact fingers 32 and the contact fingers 32 of a contact member 30 may be of the same or of different widths. In general, if the width of each contact finger is less than the width of a typical human finger, then a human operator will ordinarily deform more than one contact finger 32 when actuating switch 10 so that more than one connection will be made between the one or more contact fingers 32 deformed and conductor 26, 26*c*, which is thought to provide a more reliable switch operation.

Slots 34 produce gaps 34 between contact fingers 32 that allow for independent flexing of each contact finger and so the slot width is typically, but need not be, sufficient that adjacent contact fingers 32 do not touch when actuated. The force or pressure required to flex or deform a contact finger 32, i.e. to arcuate switch 10, is related to the width and thickness of the metal of the contact finger 32.

In the assembly of switch 10, metal contact member 30 is slipped over circuit board 20 (or circuit board 20 is slipped inside contact member 30) with the continuous edges 36 of contact member 30 in contact with circuit board 20 on the underside 24 thereof proximate its edges 23. In a preferred embodiment, contact member 30 is symmetrical and so may be assembled in either end-to-end orientation with respect to circuit board 20. Contact member 30 is permanently electrically connected to conductor 27, e.g., by soldering or welding to conductor 27 or by electrically-conductive adhesive, either at one or more locations or continuously along the length of its contact with conductor 27. Typically, edge 36 of contact member 30 is soldered to conductor 27*c*.

Thus, contact fingers 32 are positioned over and spaced away from conductor 26 from where any one or more of contact fingers 32 may be selectively deformed and brought into contact with conductor 26 when pressed, i.e. switch 10 may actuated by contact fingers 32 being deformed by force or pressure thereon directed towards circuit board 20. Contact fingers 32 return to their undeformed shape when the actuating force or pressure is removed, thereby to selectively break electrical connection with conductor 26. Thus, switch 10 provides electrical switching action between wires connected to conductors 26, 27 when force or pressure is selectively applied to any one or more of contact fingers 32.

End members 40 and 50 are assembled to the lengthwise opposing ends 28 and 29, respectively, of circuit board 20. End members 40, 50 have respective holes 41, 51 by which switch 10 may be attached to an object, e.g., by screws, bolts, nails, rivets, or other suitable fasteners. The generally flat undersides of end members 40, 50 proximate holes 41, 51 define a mounting plane 12 (generally referred to as the underside or bottom of switch 10) at which switch 10 is mounted to and/or adjacent to an object.

Thus, switch 10 may be mounted to a weapon or other object by an adhesive, such as a double-sided adhesive tape or by a hook and loop (e.g., Velcro®) fastener, as well as by one or more fasteners through holes 41, 51 as well as by a tie member engaging grooves or recesses 43, 53. Thus, even under adverse conditions, such as very high temperature and substances that degrade the adhesion of an adhesive or render it incapable of adhering to a surface, switch 10 may be mounted to a weapon or other object by means that are not affected by temperature and such substances.

End members 40, 50 typically receive circuit board 20 in recesses (described below) that space the surface 24 of circuit board 20 away from mounting plane 12 by a sufficient distance to allow clearance for the thickness of edges 36 of contact member 30 and the thickness of conformal sheath 60. End members 40, 50 are, e.g., typically a molded Delrin® homopolymer acetal plastic available from General Electric Company, Pittsfield, Mass., but may be nylon, nylon (6/6), Valox polyester, polycarbonate, liquid crystal polymer, Ultem® polyetherimide, or any other suitable material, e.g., either polymer or plastic or metal, and may be molded or machined or otherwise formed.

End member 40 has a raised surface 44 that is preferably a raised distance from mounting plane 12 that is greater than is the distance that contact fingers 32 are above mounting plane 12. End member 40 also preferably has two sloping sides 45 extending transversely from raised surface 44 and a sloping end surface 46 extending longitudinally towards circuit board 20, thereby to provide a distinct tactile shape, i.e. a shape that an operator can feel by touch, e.g., by finger touch.

The underside of end member 40 may have a recess 48 defined by raised ribs 47 along the sides thereof for receiving the tab or narrow end 28 of circuit board 20 and may also have a raised post 49 in the recess 48 that may mate with (e.g., extend into) a corresponding hole in tab 28 of circuit board 20. Recess 48 and post 49 are sized for receiving tab 28 of circuit board 20 in a defined physical relationship, thereby to provide positive relative positioning and/or alignment thereof for ease of assembly. Thus, recess 48 and post 49 are sized for receiving tab 28 of circuit board 20 thereby to define interlocking features that may, e.g., facilitate assembly. End member 40 and tab 28 of circuit board 20 may be secured, e.g., by adhesive or heat welding or other suitable means, or may be held in proper relative position by the shrinking of conforming sheath 60 around them.

End member 50 has a raised surface 54 that is preferably a raised distance from mounting plane 12 that is greater than is the distance that contact fingers 32 are above mounting plane 12. End member 50 also preferably has two sloping sides 55 extending transversely from raised surface 54 and a sloping end surface 56 extending longitudinally towards circuit board 20, thereby to provide a distinct tactile shape.

End member 50 has a channel 58 extending longitudinally therethrough for providing a passage through which wires or cable connecting to connection sites 26*a*, 27*a*, respectively, of conductors 26, 27 of circuit board 20 may pass. Channel 58 may be a through hole or may open to the underside of end member 50, but typically is not open in the region around hole 51.

The underside of end member 50 may have a recess 58 defined by raised posts 59 along the sides thereof for receiving the tab or narrow end 28 of circuit board 20. Recess 58 and posts 59 are sized for receiving necked portion 29 and tabs 29*a* of circuit board 20 in a defined physical relationship, thereby to provide positive relative positioning and/or alignment thereof for ease of assembly. Thus, recess 58 and posts 59 are sized for receiving tab 28 of circuit board 20 thereby to define interlocking features that may, e.g., facilitate assembly. End member 50 and neck 29 of circuit board 20 may be secured, e.g., by adhesive or heat welding or other suitable means, or may be held in proper relative position by the shrinking of conforming sheath 60 around them.

Where the distance of raised surface 44 of end member 40 and of raised surface 54 of end member 50 from mounting plane 12 are greater than that of contact fingers 32, switch 10 provides a distinctive tactile shape that aids an operator in locating switch 10 and placing his finger(s) in proper position for actuating switch 10 without having to look for and/or at switch 10. This feature helps avoid any inconvenience, unsafe condition and/or danger that might arise from the operator having to look away from whatever he might be observing or from an object upon which an operation is being performed.

In addition, because switch 10 has plural contact fingers 32 disposed along the length thereof and can be actuated by deforming any one or more of the plural contact fingers 32, switch 10 may be actuated at any position along its length, thereby facilitating use by different operators, including operators who may have very different hand sizes and very different finger lengths.

Desirably, switch 10 is enclosed in a flexible conforming sheath 60 that extends substantially the length of switch 10 so as to provide a closed end around end member 40 at one end and around end member 50 at the other end of switch 10. Typically, the entire switch assembly 10, excluding the mounting holes 31, 51 of the extending end members 40, 50, is covered by and enclosed within sheath 60.

Sheath 60 is preferably a heat-shrinkable plastic tube or sheath that is cut to the proper length, slipped over switch 10 and then heated so as to shrink and conform to the shape of switch 10. Specifically, sheath 10 shrinks to come into contact with and conform to end members 40 and 50, and also shrinks to come into contact with and conform to contact fingers 32 of contact member 30 and circuit board 20, thereby preserving the relative distances thereof to mounting plane 12.

An example of a suitable material for sheath 60 is a length of shrinkable tubing made of 3:1 shrink ratio PVC or 3:1 shrink ratio polyolefin material which shrinks at a temperature of about 100° C. Desirably, such shrinkable material shrinks at a temperature that is lower than the temperature at which the connections of lead wires to connection sites 26*a*, 27*a* of conductors 26, 27 of circuit board 20 might weaken or be compromised. Suitable shrink tubing is available from Newark Electronics, located in Fort Washington, Pa.

The shrink wrap plastic sheath or tube 60 covering the operating elements of switch 10 is thought to be a cost-effective way for providing enhanced support of circuit board 20 and end members 40, 50, and protection from dirt, moisture and breakage, thereby extending the useful life and functionality of the pressure actuated switch 10. If desired, switch 10 may be assembled without the use of glue or welding, where a shrinkable conforming and sealing sheath 60 is provided.

Optionally, end member 40 may have a neck portion 42 defining grooves 43 into which the end of conforming sheath 60 shrinks to provide a more definite seal, and also optionally, end member 50 may have a neck portion 52 defining grooves 53 into which the end of conforming sheath 60 shrinks to provide a more definite seal.

In one example embodiment wherein contact member 30 has seven contact fingers 32, switch 10 is about 11.5 cm (about 4.5 inches) long and about 1.5 cm (about 0.6 inche) wide. Therein, raised surfaces 44, 54 are about 6 mm (about 0.23 inch) about mounting plane 12 and contact fingers 32 are about 4.5 mm (about 0.17 inch), about mounting plane 12, thereby providing an about 1.5 mm (about 0.06 inch) difference for tactile distinctness. Therein, contact member 30 is about 4.9 cm (about 1.9 inches) long and has seven contact fingers, each about 6 mm (about 0.24 inch) wide, and separated by an about 1 mm (about 0.04 inch) slot or gap. Circuit board 20 is about 8.5 cm (about 3.35 inches) long, about 1.5 cm (about 0.6 inch) wide and about 1.5 mm (about 0.06 inch) thick. Sheath 60 is typically about 0.25–0.5 mm (about 0.01–0.02 inch) thick, which increases the above heights of raised surfaces 44, 54 and of contact fingers 32, and the width of switch 10, by a like amount. End members 40, 50 are about 1.2 cm (about 0.5 inch) wide.

In another example embodiment wherein contact member 30 has nine contact fingers 32, switch 10 is about 13 cm (about 5.1 inches) long and about 1.5 cm (about 0.6 inch) wide. Therein, raised surfaces 44, 54 are about 8.3 mm (about 0.33 inch) above mounting plane 12 and contact fingers 32 are about 4.5 mm (about 0.2 inch), above mounting plane 12, thereby providing an about 3.3 mm (about 0.13 inch) difference for tactile distinctness. Contact member 30 is about 6.4 cm (about 2.5 inches) long. Circuit board 20 is about 9.5 cm (about 3.9 inches) long, about 1.5 cm (about 0.6 inch) wide and about 1.5 mm (about 0.06 inch) thick. Sheath 60 is typically about 0.25–0.5 mm (about 0.01–0.02 inch) thick, which increases the above heights of raised surfaces 44, 54 and of contact fingers 32, and the width of switch 10, by a like amount. End members 40, 50 are about 1 cm (about 0.4 inch) wide.

In a preferred embodiment, switch 10 provides enhanced ergonomic characteristics which allow the user's fingers to better sense where to be placed on the pressure elements (contact fingers 32) of the actuator. Specifically, the pressure sensitive switch 10 has raised opposing ends 40, 44, 50, 54 which act as a "tactical guide" to the user to optimize placement of the user's fingers directly on the pressure sensitive elements 32 of the remote switch without looking thereat or while in darkness. This arrangement may reduce instances of inadvertent actuation, which when switch 10 is used in certain tactically critical operations is vital to the effectiveness and safe operation of the tool or weapon.

In addition, the feature of plural contact fingers 32 along the length of switch 10, which is a result of the arrangement attaching stamped contact member 30 to circuit board 20, is to ease actuation by enabling the user to apply simple pressure at any point or section of the stamping. The plural contact fingers 32, in addition to providing a relatively broad contact area with conductor 26 may also provide improved reliability due to the usual condition wherein actuation causes more than one contact finger to come into contact with conductor 26.

End members 40, 50 extending from circuit board 20 may have one or more notches, tabs, posts and/or ribbed contours 47, 48, 49, 58, 59 which are mated or joined to one or more corresponding notches, tabs, holes and/or mating contours 28, 29, 29*a* of circuit board 20. Adhesive, such as a hot-melt glue, may be used to bind the end members 40, 50 to circuit board 20. In addition, the wire or cable passing through opening or tunnel 58 may also be adhesively or otherwise secured to end member 50.

Figure 5:
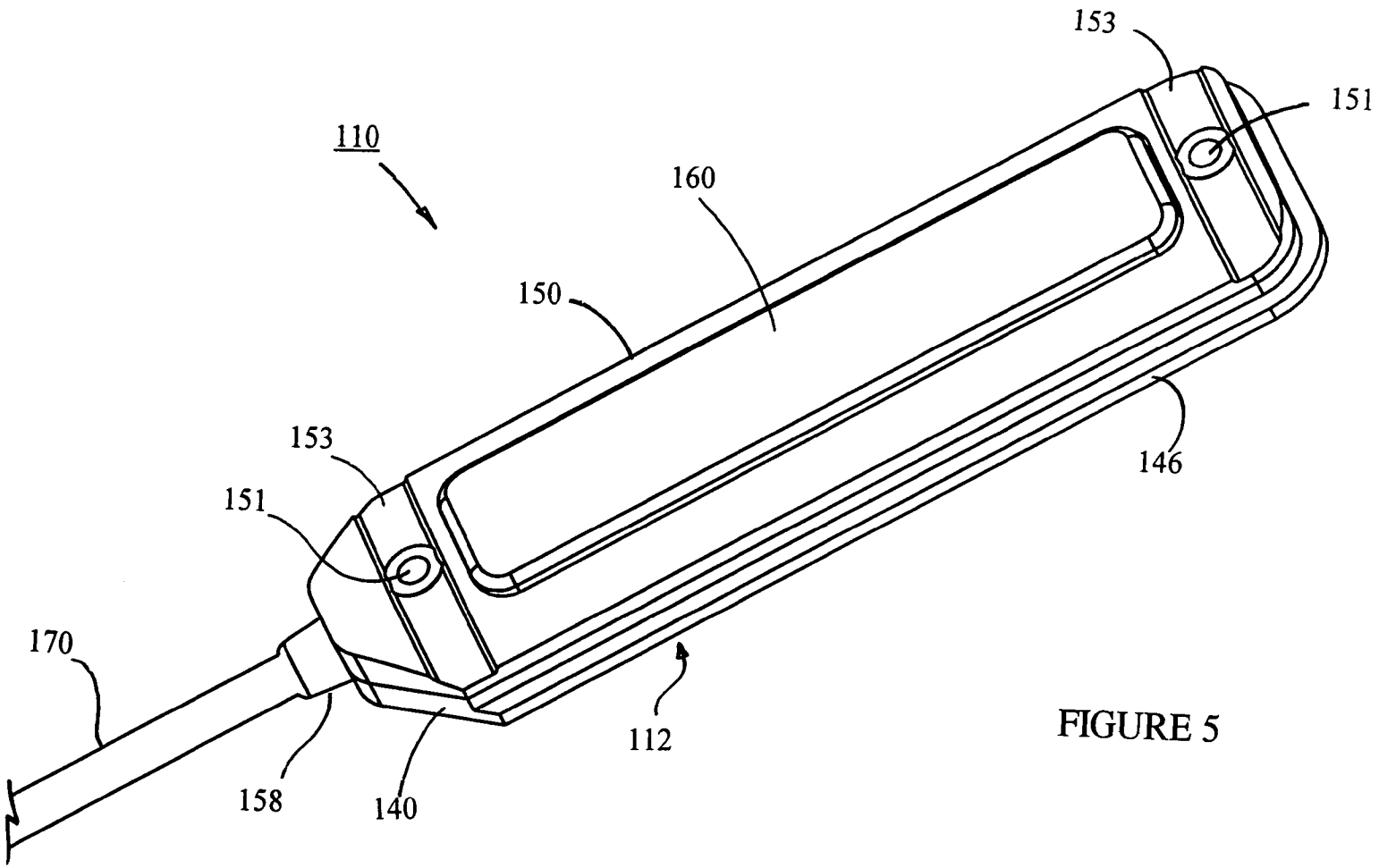
FIG. 5 is an isometric view of another example embodiment of a switch including the present arrangement.

FIG. 5 is an isometric view of another example embodiment of a switch 110 including the present arrangement. Switch 110 has a generally rectangular housing comprising front housing 140 and rear housing 140 in which the electro-mechanical switch elements are disposed. Force or pressure for actuating the electro-mechanical switch elements within housing 140, 150 is applied via flexible boot 160 disposed in an opening of front housing 150. An electrical cable 170 containing electrical wires extends from strain relief grommet 158 at one end of housing 140, 150 for connecting electrical switch 110 to an electrical device that it is intended to control or signal.

Preferably, the electro-mechanical switch elements of switch 110 are enclosed within a flexible conforming boot 160 that engages between housing members 140 and 150 for keeping dirt, water, and other debris and foreign matter from easily reaching the electro-mechanical switch elements.

Housing 140, 150 of switch 110 includes provisions for at least three different types of mounting. Holes 151 are provided to receive a fastener, e.g., a screw or bolt, and transverse grooves 153 are provided to receive a tie member, e.g., a cord, string, elastic band, plastic tie (e.g., a Tie-Wrap tie), wire tie, or cable tie, to secure switch 110 to an object. And mounting surface 112 of rear housing portion 140 provides a surface for adhesive mounting of switch 110, e.g., by adhesive, two-sided adhesive tape, hook-and-loop fasteners (e.g., Velcro fastener), and the like. Suitable adhesives and adhesive tapes may be permanent or may be releasable.

Thus switch 110 may be mounted to a weapon or other object by an adhesive, such as a double-sided adhesive tape or by a hook and loop (e.g., Velcro®) fastener, as well as by one or more fasteners through holes 141, 151 as well as by a tie member engaging grooves or recesses 153. Thus, even under adverse conditions, such as very high temperature and substances that degrade the adhesion of an adhesive or render it incapable of adhering to a surface, switch 110 may be mounted to a weapon or other object by means that are not affected by temperature and such substances.

In addition, housing 140, 150 may be provided with a pair of substantially parallel outwardly extending flanges 146 on opposing edges thereof for slidably mounting switch 110 into a set of substantially parallel opposing grooves, as might be provided on an object to which switch 110 may be mounted. In such case, switch 110 would slide into the mount with flanges 146 in the opposing grooves, and could be retained by a latching feature or by friction between the flanges and the grooves, e.g., provided by draft (convergence) in either the flanges or in the grooves, or both.

Figure 6:
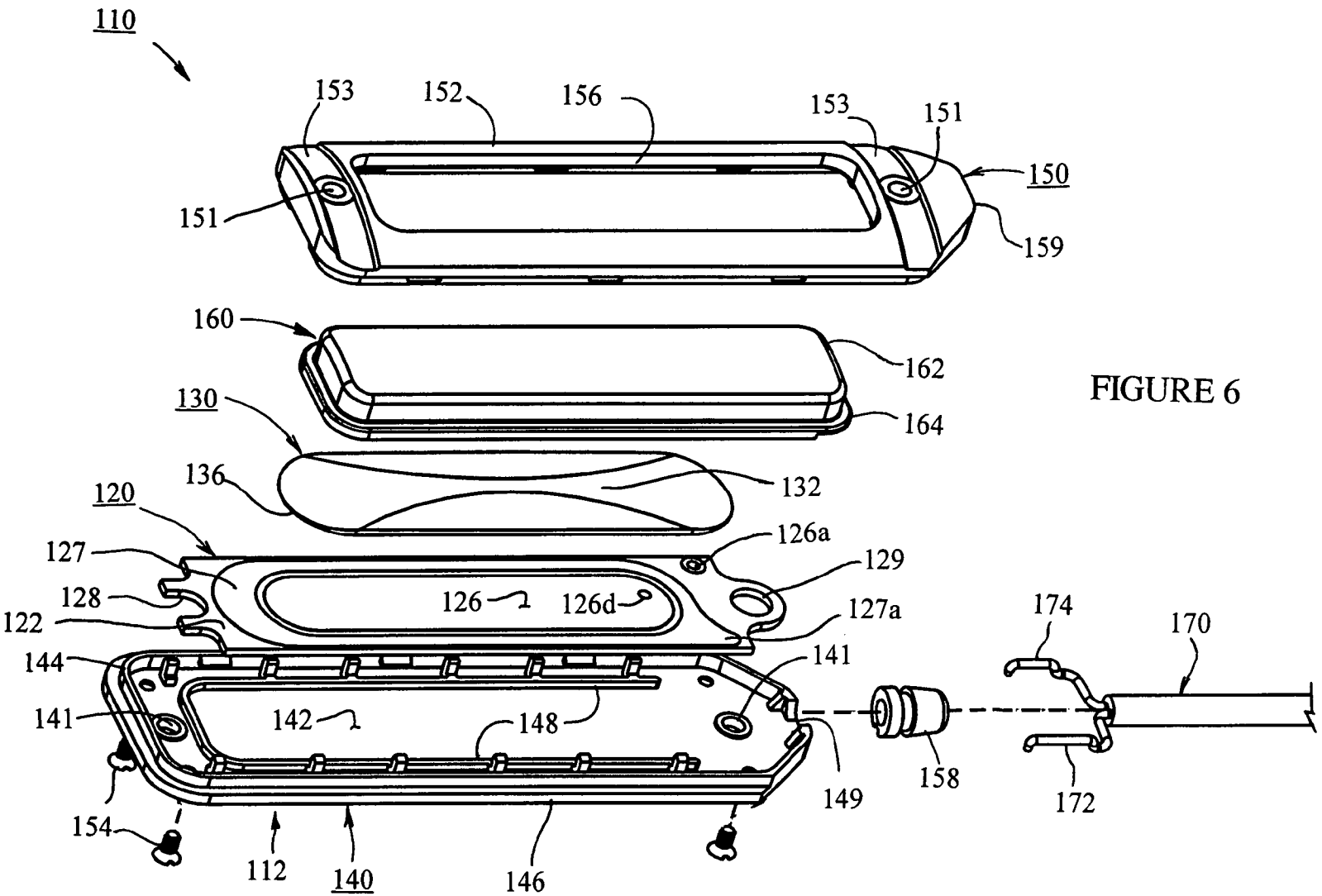
FIG. 6 is an exploded isometric view of the example switch embodiment of FIG. 5.
Figure 7A:
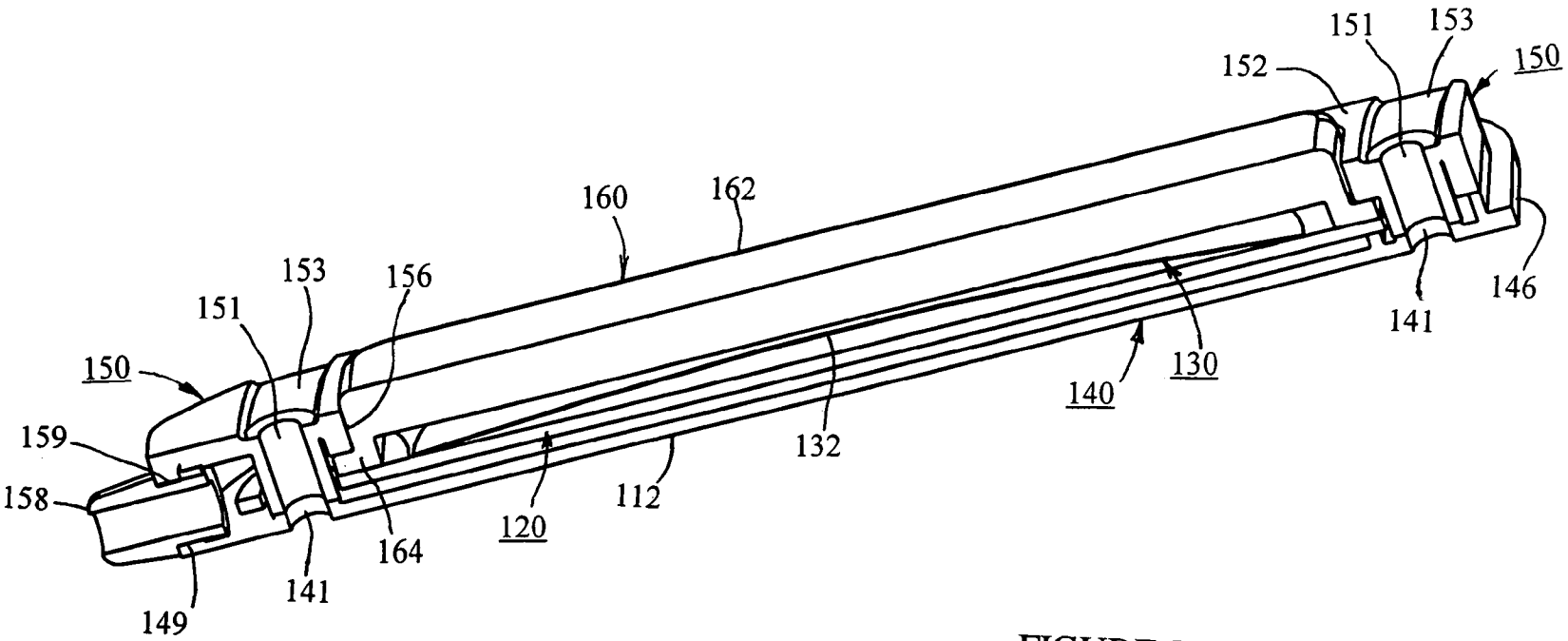
FIGS. 7A and 7B are longitudinal and transverse cross-sectional views, respectively, of the example switch embodiment of FIGS. 5 and 6.
Figure 7B:
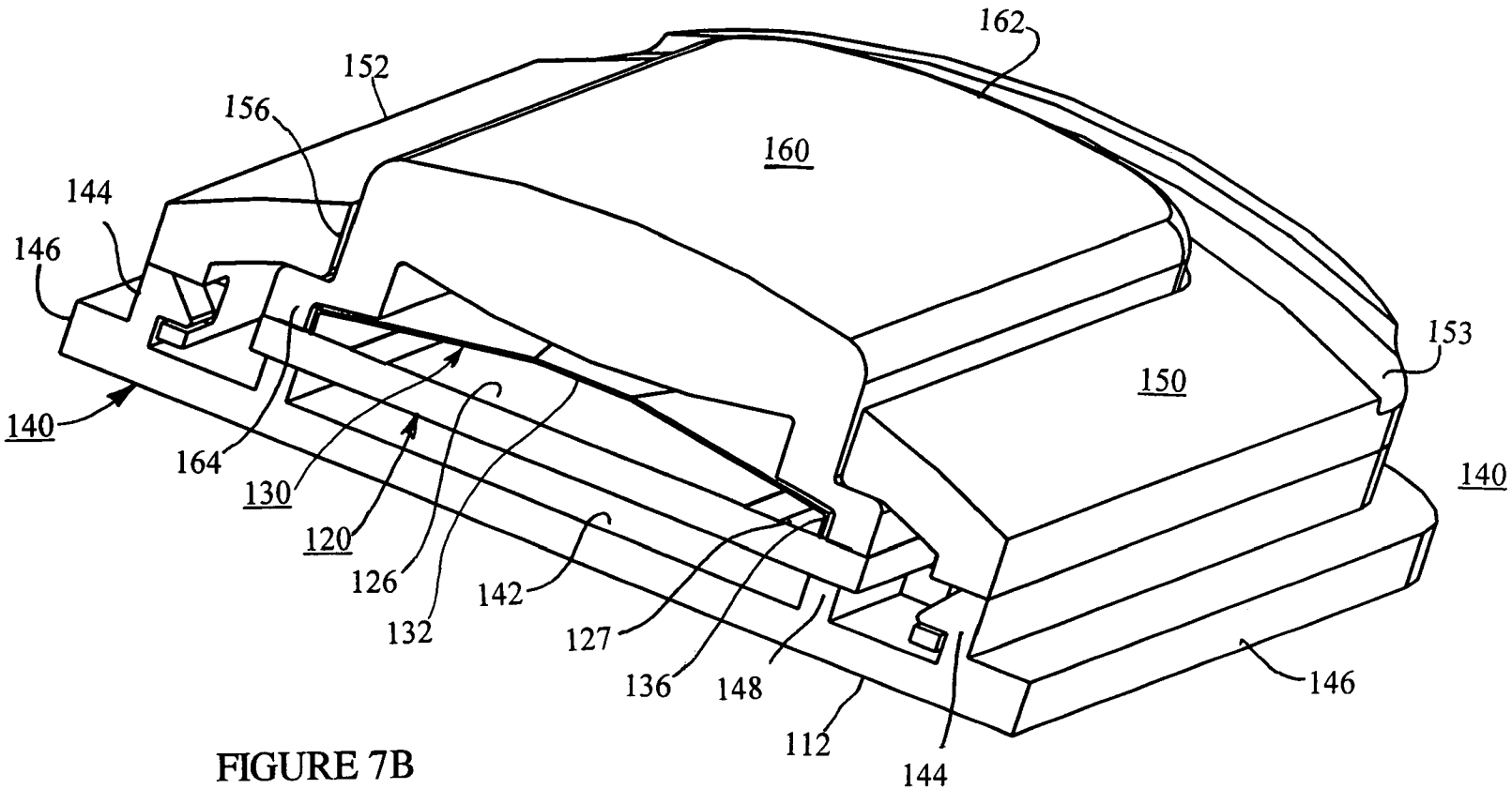

Switch 110 is described in detail in relation to FIGS. 5 and 6 which is an exploded isometric view thereof and in relation to FIGS. 7A and 7B which are longitudinal and transverse cross-sectional views, respectively, thereof.

Central to switch 110 is dielectric substrate 120, e.g., a printed wiring electrical circuit board, having patterned electrical conductors 126 and 127 on surface 122 thereof for connecting to the flexible metal switch element 130 and to provide locations proximate one end of circuit board 120 to which lead wires of electrical cable 170 are connected, e.g., by soldering. Conductor 126 extends generally lengthwise along a central region of surface 122 of circuit board 120 and conductor 127 extends generally around the peripheral edges of surface 122 thereof. Each of conductors 126, 127 may have a connection site 126*a*, 127*a*, respectively, at which electrical lead wires 172, 174 may be connected, e.g., by soldering, welding, or conductive adhesive.

Circuit board 120 has a conductor (not visible) providing electrical connection between connection point 127*a* and via 127*d* of conductor 127, e.g.; by a patterned printed or etched conductor or by a wire. Connection points 126*a*, 127*a*, 127*d* may be one or more plated-through holes or conductive vias between surface 22 and the opposing surface of circuit board 120. Circuit board 120 is typically made from a copper-clad epoxy-glass circuit board material or from a copper-clad FR4 material or from a copper-clad phenolic circuit board material, but may be of other suitable materials, such as ceramic or polyimide. Conductors 126, 127, and plated holes/vias 126*a*, 127*a*, 127*d*, are applied, patterned, etched and/or otherwise made in conventional manner.

Preferably, conductor 126 extends lengthwise along surface 122 of circuit board 120 a sufficient distance to underlie all of the contact area of flexible metal contact member 30 when switch 110 is assembled. While printed circuit conductor 26 on circuit board 120 is sufficient for proper operation of switch 110, conductor 126 may be raised or elevated above the surface 122 of circuit board 120 so as to provide a contact region closer to, but still spaced apart from, contact member 130 than is surface 122 of circuit board 120. Typically, a length of electrically conductive material, e.g., of a bare wire or rod or bar or plate of a copper or brass, may be soldered along the portion of conductor 126 that underlies contact member 130. Optionally, conductors 126, 127 and/or any conductor soldered thereto may be tinned, coated or plated so as to decrease the likelihood of oxidation and such plating may also serve to increase the conductivity and current carrying capacity thereof.

Metal contact member 130 is typically stamped from a flat sheet of springy electrically conductive metal and formed into a domed or arcuate shape. For example, member 130 may be stamped as a generally rectangularly shaped piece having a number of creased lines therein to define a raised or arcuate region 132. Preferably, conductor 126 is of similar shape and size to the shape and size of peripheral edge 136 of contact member 130 so as to make electrical contact therewith.

Metal contact member 130 is formed having a curved or domed shape so as to have a central region 132 that is spaced away from the surface 122 of circuit board 120 when placed thereon. Contact member 130 may be of beryllium copper, stainless steel, phosphor bronze, copper-clad spring steel, springy brass or other suitable conductive material, and may be plated, e.g., with sulfamate nickel or other suitable plating. One or more contact members may be employed.

It is noted that the arcuate contact member 130 may be formed to have a curved shape, a domed shape, a segmented folded shape, or any other arcuate shape, the particular shape being immaterial so long as contact region 132 is spaced apart from conductor 126 of circuit board 120 and is deformable by an actuating force to come into contact with conductor 126 thereof. Typically, contact member 130 is available in a given or standard size, and the width and length of circuit board 120 and conductors 126, 127 thereon are selected to be compatible therewith.

Examples of suitable contact members 130 include the E-series type of metal dome momentary switch contacts available from Snaptron, Inc. which has an office in Loveland, Colo., or of the type M/N 2-ODN-14 available from Mel Bowman & Associates which has an office in Costa Mesa, Calif.

Thus, the central contact region 132 of flexible metal member 130 is positioned over and spaced away from conductor 126, and any portion or all of contact region 132 may be deformed and brought into contact with conductor 126 when pressed, i.e. switch 110 may actuated by contact member 130 being deformed by force or pressure thereon directed towards circuit board 120. Contact member 130 returns to its undeformed shape when the actuating force or pressure is removed, thereby to selectively break electrical connection with conductor 126. Thus, switch 110 provides electrical switching action between the wires 172, 174 that are connected to conductors 126, 127 when force or pressure is selectively applied to contact member 130.

Housing members 140 and 150 are assembled together to provide a housing 140, 150 for switch 110. Rear housing 140 preferably has projecting features, such as the perpendicular hollow cylindrical members defining holes 141, for engaging features at opposing ends 128 and 129, respectively, of circuit board 120. Housing 140, 150 has respective holes 141, 151 by which switch 110 may be attached to an object, e.g., by screws, bolts, nails, rivets, pins, or other suitable fasteners. The generally flat underside 112 of rear housing 140 defines a mounting plane 112 (generally referred to as the underside or bottom of switch 110) at which switch 110 is mounted to and/or adjacent to an object.

Rear housing 140 typically receives circuit board 120 in a recess 142, e.g., defined by a raised flange or rim 148, that locates circuit board 120 with respect to front housing 150 and boot 160 when assembled. Recess 142 also typically locates contact member 130 with respect to circuit board 120, although contact member 130 may be attached to circuit board 120, e.g., by adhesive, tape, solder or the like. Housing members 140, 150 are, e.g., typically a molded Delrin® homopolymer acetal plastic available from General Electric Company, Pittsfield, Mass., but may be nylon, nylon (6/6), Valox polyester, polycarbonate, liquid crystal polymer, Ultem® polyetherimide, or any other suitable material, e.g., either polymer or plastic or metal, and may be molded or machined or otherwise formed.

Housing 140, 150 preferably has a cylindrical opening at one end thereof that has an inwardly projecting circular flange for engaging a corresponding groove of flexible grommet 158, thereby to retain grommet 158 in housing 140, 150 and compressing grommet 158 against cord or cable 170. This tends to provide strain relief for cord or cable 170 and so reduces tension on leads 172, 174 and their solder or conductive adhesive connections 126*a*, 127*a* to circuit board 120. Each of housing 140 and 150 has a substantially semi-cylindrical opening with an inward flange for defining the cylindrical opening with flange when parts 140 and 150 are juxtaposed to provide housing 140, 150.

Desirably, internal elements 120, 130 of switch 110 are enclosed in a flexible conforming sheath or boot 160 that is disposed in an opening 156 in front housing 150, typically extending substantially the length of switch 110 so as to provide a broad actuation area. Flexible boot 160 is preferably hat shaped having a crown or raised portion 162 that is disposed in the opening 156 of front housing 150 and presented as the region upon which to apply force or pressure for actuating switch 110. Preferably, crown portion 162 is thicker at its center than at its edges, e.g., so as to be flexible while tending to concentrate the applied force or pressure substantially in the central region 132 of flexible switch member 130. The under side of crown 162, i.e. that closest to metal member 130, may in addition have a projection extending towards the central region 132 of flexible metal member 130 so as to better define the location on metal member 130 whereat the applied actuating force or pressure is to be concentrated.

Flexible boot 160 preferably has a substantially planar brim or peripheral outward flange 164 that is clamped between corresponding features of housings 140, 150 as may be seen in FIGS. 7A and 7B. Boot 160 is thought to be a cost-effective way for providing protection from dirt, moisture and breakage, thereby extending the useful life and functionality of the pressure actuated switch 110. If desired, switch 110 may be assembled by joining front and rear housings 140, 150 together, e.g., with an adhesive or glue, or using sonic, ultrasonic, heat or other form of welding, or by providing corresponding matching latching or clasping features on housing portions 140 and 150 so that they snap engage when pressed together, or by fasteners such as screws 154 or pins and the like. Respective rims or other features on housings 140 and 150 may be provided to guide housings 140, 150 into a desired positional relationship when they are brought together.

Flexible boot 160 may be made of any suitable flexible plastic or rubbery material, such as a rubber, vulcanized rubber or thermoplastic elastomer. Other materials may include neoprene, Santoprene elastomer, polyolefin, polyethylene, PVC and the like. An example of a suitable material for boot 160 is thermoplastic elastomer such as ALCRYN melt processable rubber available from E.I. duPont Canada Company located in Mississauga, Ontario.

One typical embodiment of a switch 110 is about 3.16 inches long and about 0.95 inch wide and about 0.38 inch thick. A typical boot 160 thereof is about 2.25 inches long, about 0.6 inch wide, and about 0.2 inch high, and actuates a flexible metal member 130 that is about 2 inches long and about ½ inch wide. Mounting holes 151 and mounting grooves 153 are preferably spaced apart by a distance corresponding to a hole spacing on a standard mounting rail, e.g., about 2.5 inches.

A pressure actuated electrical switch 10, 110 comprises a dielectric substrate 20, 120 having on a first surface 22, 122 thereof a first electrical conductor 27, 127 extending in one direction near at least one edge thereof and having a second electrical conductor 26, 126 extending in the one direction in a central region thereof, and an arcuate flexible metal contact member 30, 130 juxtaposed to the first surface 22, 122 of the dielectric substrate 20, 120. Arcuate flexible metal contact member 130 has a first edge 36, 136 proximate and electrically connecting to first electrical conductor 27, 127 of dielectric substrate 20, 120 and has an arcuate central region 32, 132 overlying second electrical conductor 26, 126 thereof for making electrical contact therewith when actuating force or pressure is applied to arcuate flexible metal contact member 30, 130, whereby applying actuating force or pressure to deform arcuate flexible metal contact member 30, 130 causes an electrical connection to be made between the first and second electrical conductors 26–27, 126–127 via arcuate flexible metal contact member 30, 130. Dielectric substrate 20, 120 and arcuate flexible metal member 30, 130 are mounted to mounting means 40. 50, 140, 150 for mounting the electrical switch 10, 110 to an object employing any one or more of a fastener, a tie member and an adhesive member.

A flexible cover 60, 160 is juxtaposed to arcuate flexible metal contact member 30, 130 at a surface thereof distal the first surface of dielectric substrate 20, 120, whereby arcuate flexible metal contact member 30, 130 is between flexible cover 60, 160 and dielectric substrate 20, 120. Flexible cover 60, 160 may comprise a shaped flexible boot 60 retained over arcuate flexible metal contact member 130 by mounting means 140, or a shaped flexible boot 60 having a crown portion 162 positioned over arcuate flexible metal contact member 130 and having a brim portion 164 retained by mounting means 140, 150, or a flexible sheath 60 enclosing dielectric substrate 20, 120 and arcuate flexible metal contact member 30, 130.

Arcuate flexible metal contact member may comprise a metal member 130 having a flexible domed central region 132 and a generally planar periphery 136, wherein the periphery 136 thereof is in electrical contact with first electrical conductor 127 of dielectric substrate 120, or a metal member 30 having a plurality of flexible arcuate shaped adjacent contact fingers 32 extending from at least one continuous edge 36 thereof, wherein the at least one continuous edge 36 thereof is in electrical contact with first electrical conductor 27 of dielectric substrate 20. Arcuate flexible metal contact member 30 may comprise a flexible metal member 30 having a plurality of arcuate shaped adjacent contact fingers 32 extending between first and second continuous edges 36 at opposite ends thereof, wherein flexible metal member 30 is formed in a "C" shape with dielectric substrate 20 disposed therein with opposing edges of dielectric substrate 20 proximate continuous edges 36 of flexible metal member 30, wherein at least one of the continuous edges 36 of flexible metal member 30 is in electrical contact with first electrical conductor 27 of dielectric substrate 20 and the arcuate shaped adjacent contact fingers 32 overlie first electrical conductor 27 thereof.

Mounting means 40, 50, 140, 150 may comprise a housing 140, 150 having dielectric substrate 120 and arcuate flexible metal member 130 disposed therein, housing 140, 150 having a mounting hole 141, 151 adapted to receive a fastener, a transverse recess 153 adapted to receive a tie member and a mounting surface 112 adapted to receive an adhesive member; or a housing 140, 150 having dielectric substrate 120 and arcuate flexible metal member 130 disposed therein, housing 140, 150 comprising a front housing 150 having a mounting hole 151 adapted to receive a fastener and a transverse recess 153 adapted to receive a tie member, and a rear housing 150 having a mounting hole 141 aligned with the mounting hole 151 of front housing 150 to receive a fastener and having a mounting surface 112 adapted to receive an adhesive member; or first and second end members 40, 50 attached to opposite ends of dielectric substrate 20 each a mounting hole 41, 51 adapted to receive a fastener, a transverse recess 43, 53 adapted to receive a tie member and a mounting surface 12 adapted to receive an adhesive member. Housing 140, 150 may further include an outwardly extending flange 146 along at least two opposing edges thereof; or first and second end members 40, 50 may have respective raised surfaces 44, 54 that are a greater distance from dielectric substrate 20 than is the arcuate central region 32 of arcuate flexible metal contact member 30.

An electrical switch 10, 110 comprises first and second electrical conductors 26, 27, 126, 127, 172, 174, an electrically conductive contact member 30, 130 electrically connected to first electrical conductor 27, 127, 172 and spaced apart from second electrical conductor 26, 126, 174 for contacting second electrical conductor 27, 127, 174 when actuated, and a mounting 40, 50, 140, 150 supporting first and second electrical conductors 26, 27, 126, 127, 172, 174 and electrically conductive contact member 30, 130, mounting 40, 50, 140, 150 having at least one hole 41, 51, 141, 151 for mounting electrical switch 10, 110 to an object by a fastener, having at least one groove or recess 43, 53, 143, 153 for mounting electrical switch 10, 110 to an object by a tie member and having at least one surface 12, 112 for mounting electrical switch 10, 110 to an object by an adhesive member.

Mounting 40, 50 may comprise first and second end members 40, 50, wherein first and second end members 40, 50 have the at least one hole 41, 51 for mounting electrical switch 10 to an object by a fastener, have the at least one groove or recess 43, 53 for mounting electrical switch 10 to an object by a tie member and have the at least one surface 12 for mounting electrical switch 10 to an object by an adhesive member. First and second end members 40, 50 may have respective raised surfaces 44, 54 that are a greater distance from mounting surface 12 of mounting 40, 50 than is electrically conductive contact member 30. First and second end members 40, 50 may have the at least one hole 41, 51 for mounting electrical switch 10 to an object by a fastener, have the at least one groove or recess 43, 53 for mounting electrical switch 10 to an object by a tie member and have the at least one surface 12 for mounting electrical switch 10 to an object by an adhesive member. First and second end members 40, 50 may have respective raised surfaces 44, 54 that are a greater distance from mounting surface 12 of mounting 40, 50 than is electrically conductive contact member 30.

A flexible sheath 60 may enclose electrically conductive contact member 30, at least a portion of first and second electrical conductors 26, 27, 126, 127, 172, 174, and at least a portion of first and second end members 40, 50.

Mounting 140, 150 may comprise a front housing 150 and a rear housing 140, front housing 140 having the at least one mounting hole 151 adapted to receive a fastener and having the at least one groove or recess 153 adapted to receive a tie member, and rear housing 140 having an at least one mounting hole 141 aligned with the at least one mounting hole 151 of the front housing 150 to receive a fastener and having the at least one mounting surface 112 adapted to receive an adhesive member. A shaped flexible cover 160 may cover electrically conductive contact member 130, wherein front housing 150 has an opening 156 exposing shaped flexible cover 160. Shaped flexible cover 160 may include a crown portion 162 positioned over electrically conductive contact member 130 and exposed by opening 156 in front housing 150 and a brim portion 164 retained between front housing 150 and rear housing 140.

Mounting 40, 50, 140, 150 may further include an outwardly extending flange 146 along at least two opposing edges thereof; or may have respective raised surfaces 44, 54 proximate opposing ends thereof that are a greater distance from mounting surface 12 of mounting 40, 50 than is electrically conductive contact member 30.

A pressure actuated electrical switch 10 comprises a dielectric substrate 20 having first and second electrical conductors 26, 27 thereon, and an electrically conductive contact member 30 having a plurality of deformable contact fingers 32 overlying the electrical conductor 26 of dielectric substrate 20 for contacting first electrical conductor 26 when deformed, wherein contact member 30 is electrically connected to the second electrical conductor 27 of dielectric substrate 20, whereby deforming any one or more of the contact fingers 32 towards dielectric substrate 20 causes an electrical connection to be made between first and second electrical conductors 26, 27. First and second end members 40, 50 may be attached to opposite ends 28, 29 of dielectric substrate 20, wherein first and second end members 40, 50 provide respective first and second mounting points 40, 50 for electrical switch 10; or have respective raised surfaces 44, 54 that are a greater distance from dielectric substrate 20 than are the plurality of contact fingers 32 of contact member 30; or provide respective first and second mounting points 40, 50 for electrical switch 10 and have respective raised surfaces 44, 54 that are a greater distance from dielectric substrate 20 than are the plurality of contact fingers 32 of contact member 30.

A flexible sheath 60 may enclose dielectric substrate 20 and contact member 30 and at least a portion of first and second end members 40, 50. Each of first and second end members 40 50 may have a respective interlocking feature 28, 29, and dielectric substrate 20 may have interlocking features 49, 59 corresponding to and interlocking with interlocking features 28, 29 of first and second end members 40, 50. Each of first and second end members 40, 50 may have a respective mounting hole 41, 51 adapted to receive a fastener, a respective transverse recess 43, 53 adapted to receive a tie member and a respective mounting surface 12 adapted to receive an adhesive member.

Electrical switch 10 may comprise a flexible sheath 60 enclosing dielectric substrate 20 and contact member 30. An electrically conductive member 26*c* may be on first electrical conductor 126 of dielectric substrate 20, whereby deforming any one or more of contact fingers 32 towards dielectric substrate 20 causes an electrical connection to be made between the first and second electrical conductors 26, 27 via the electrically conductive member 26*c*.

A pressure actuated electrical switch 10 comprises first and second end members 40, 50 each having a mounting surface 12 suitable for mounting against an object and each having a raised portion 44, 54 opposing the mounting surface 12 and spaced therefrom by a given dimension, thereby to define a height of each of first and second end members 40, 50. A switch member 20, 30 extends between and is attached to first and second end members 40, 50 and has a flexible contact member 30 defining a ridge extending in a direction from first end member 40 to second end member 50, wherein the ridge of flexible contact member 30 will be spaced apart from the object by a distance less than the given dimension of end members 40, 50 if and when electrical switch 10 is mounted against the object, thereby to define a height of switch member 20, 30. An electrical conductor 26, 26*a*, 26*c* is disposed within switch member 30 for being contacted by flexible contact member 30 when an actuating force is applied to deform flexible contact member 30. Thus, flexible contact member 30 is disposed between raised portions 44, 54 of end members 40, 50 at a height that is less than the height of first and second end members 40, 50.

Flexible sheath 60 may enclose switch member 20, 30 and at least a portion of first and second end members 40, 50, and conform thereto. Flexible contact member 30 may include a plurality of adjacent formed contact fingers 32 defining the ridge.

Switch 10, 110 may be utilized as a remote switch, e.g., as an adapter switch or actuator for a flashlight, laser, or similar light source or aiming device, when attached or mounted to a shotgun or rifle or other weapon, wherein the switch 10 is typically mounted proximate the trigger. In addition, switch 10, 110 may be utilized as a remote actuator of any other apparatus, whether fixed or portable. Switch 10, 110 and the apparatus it actuates and/or controls may be separated by a short distance or may be far apart, limited only by the electrical resistance of the wire or cable 170 therebetween and the electrical requirements of the apparatus.

While the surface or mounting plane 12, 112 of switch 10, 110 that lies near to and/or against an object to which it is mounted is generally referred to as the "bottom" or "under" side or surface, and the surface to which actuating pressure is applied is generally referred to as the "top" or "upper" side or surface, it is understood that switch 10, 110 may be utilized in any orientation, and so the "top" and "bottom" need not face upward and downward, respectively, but may face up or down or to the side or in any other direction. Likewise, terms such as "over" and "under" do not necessarily connote a particular, e.g., vertical, direction.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such.

While the present arrangement has been described in terms of the foregoing exemplary embodiments, variations within the scope and spirit of the present invention as defined by the claims following will be apparent to those skilled in the art. For example, a generally rectangular contact member 130 of the sort described in relation to switch 110 may be employed in switch 10 and/or a fingered contact member 30 of the sort described in relation to switch 10 may be employed in switch 110.

In addition, contact member 30 is described as a one-piece formed member having plural contact fingers 32 and contact member 130 is described as a single element, and such is desirable, however, contact member 30 could be provided by a plurality of separate contact fingers 32 that are individually connected to circuit board 20, 120, e.g., by soldering to conductor 27, 127, and plural contact members 130 could be placed end-to-end or side-by-side in one switch 10, 110.

Further, contact member 30 is described as having two continuous edges 36, but could have only one such edge 36 with separate contact fingers at the other edge thereof. In such case, either the continuous edge 36 or the ends of contact fingers 32 could be connected to circuit board 20, e.g., by soldering to conductor 27. In addition, plural contact members 130 may be stacked on the other so as to require a greater force to deform and to actuate switch 110. The term circuit board may be used to describe a dielectric substrate on which are electrical conductors, e.g., printed, etched or other patterned conductors and/or wires.

While end member 40 is described as having a recess 48 and/or post 49, and end member 50 as having raised posts 59 defining a necked-down portion, either or both end members could have the recess and/or post, or either or both end members could have raised posts defining a necked-down portion, or either or both end members could have another arrangement or could have no interlocking features. Similarly, the cylindrical features defining holes 141 could be of other shape or other projecting features could be provided for locating circuit board 120, however, no such features need be provided.

While provision 40, 41, 50, 51, 141, 151 is made for mounting switch 10, 110 onto a shotgun or rifle or other object by securing each end of the switch onto the stock of a shotgun or rifle with screws or blots or another fastener in holes 41, 51, 141, 151, switch 10, 110 may also be mounted by tying or a strap passing through grooves 43, 53, 153, by adhesive means on surfaces of 40, 50 and/or 60, and on surface 112.

Although switch 10, 110 may be of any desired size, it may be preferred in certain cases that the spacings between mounting holes 41, 51, 141, 151 and between mounting grooves 43, 53, 153 be about the same as the spacings between holes and/or grooves and/or other features of "standard" or particular mounting rails for mounting accessories, such as lights, aiming devices and switches, to weapons, or of various mounting arrangements provided on a weapon, whether or not "standard."

Fastener as used in relation to mounting a switch is intended to encompass any one or more of a screw, a blot, a nail, a rivet, a pin, a snap, or any other suitable means of fastening. Tie member as used in relation to mounting a switch is intended to encompass any one or more of a cord, string, rope, elastic band, plastic tie (e.g., a Tie-Wrap tie), a wire tie, a cable tie, a hook and loop strap (e.g., a Velcro® strap), a clip, a clasp, or any other means of binding, mounting or attaching. Adhesive and adhesive member as used in relation to mounting a switch is intended to encompass any means of adhering the switch to an object, e.g., any one or more of an adhesive, adhesive tape, double-sided adhesive tape, a hook and loop fastener or strap (e.g., a Velcro® fastener), or by some other means of bonding, mounting or attaching.

What is claimed is:

1. An electrical switch comprising:

a dielectric substrate having on a first surface thereof a first electrical conductor extending in one direction near at least one edge thereof and having a second electrical conductor extending in the one direction in a central region thereof;

an arcuate flexible metal contact member juxtaposed to the first surface of said dielectric substrate, said arcuate flexible metal contact member having a first edge proximate and electrically connecting to the first electrical conductor of said dielectric substrate and having an arcuate central region overlying the second electrical conductor thereof for making electrical contact therewith when actuating force or pressure is applied to said arcuate flexible metal contact member, whereby applying actuating force or pressure to deform the arcuate flexible metal contact member causes an electrical connection to be made between the first and second electrical conductors via the arcuate flexible metal contact member; and mounting means to which said dielectric substrate and said arcuate flexible metal member are mounted, said mounting means comprising means for mounting said electrical switch to an object employing any one or more of a fastener, a tie member and an adhesive member.

2. The electrical switch of claim 1 further comprising a flexible cover juxtaposed to said arcuate flexible metal contact member at a surface thereof distal the first surface of said dielectric substrate, whereby said arcuate flexible metal contact member is between said flexible cover and said dielectric substrate.

3. The electrical switch of claim 2 wherein said flexible cover comprises:

a shaped flexible boot retained over said arcuate flexible metal contact member by said mounting means; or a shaped flexible boot having a crown portion positioned over said arcuate flexible metal contact member and having a brim portion retained by said mounting means; or a flexible sheath enclosing said elongate dielectric substrate and said arcuate flexible metal contact member.

4. The electrical switch of claim 1 wherein said arcuate flexible metal contact member comprises:

a metal member having a flexible domed central region and a generally planar periphery, wherein the periphery thereof is in electrical contact with the first electrical conductor of said dielectric substrate; or a metal member having a plurality of flexible arcuate shaped adjacent contact fingers extending from at least one continuous edge thereof, wherein the at least one continuous edge thereof is in electrical contact with the first electrical conductor of said dielectric substrate.

5. The electrical switch of claim 1 wherein said arcuate flexible metal contact member comprises a flexible metal member having a plurality of arcuate shaped adjacent contact fingers extending between first and second continuous edges at opposite ends thereof, wherein said flexible metal member is formed in a "C" shape with the dielectric substrate disposed therein with opposing elongated edges of said dielectric substrate proximate the continuous edges of said flexible metal member, wherein at least one of the continuous edges of said flexible metal member is in electrical contact with the first electrical conductor of said dielectric substrate and the arcuate shaped adjacent contact fingers overlie the first second electrical conductor thereof.

6. The electrical switch of claim 1 wherein said mounting means comprises:

a housing having said dielectric substrate and said arcuate flexible metal member disposed therein, said housing having a mounting hole for receiving a fastener, a transverse recess for receiving a tie member and a mounting surface for receiving an adhesive member; or a housing having said dielectric substrate and said arcuate flexible metal member disposed therein, said housing comprising a front housing and a rear housing, said front housing having a mounting hole for receiving a fastener and a transverse recess for receiving a tie member, and said rear housing having a mounting hole aligned with the mounting hole of said front housing to receive a fastener and having a mounting surface for receiving an adhesive member; or first and second end members attached to opposite ends of said dielectric substrate, each of said end members having a mounting hole for receiving a fastener, a transverse recess for receiving a tie member and a mounting surface for receiving an adhesive member.

7. The electrical switch of claim 6 wherein said first and second end members have respective raised surfaces that are a greater distance from said dielectric substrate than is the arcuate central region of said arcuate flexible metal contact member.

8. The electrical switch of claim 6 wherein said housing further includes an outwardly extending flange along at least two opposing edges thereof.

9. An electrical switch comprising:

first and second electrical conductors;

an electrically conductive contact member electrically connected to the first electrical conductor and spaced apart from the second electrical conductor for contacting the second electrical conductor when actuated; and a mounting supporting said first and second electrical conductors and said electrically conductive contact member, said mounting having at least one hole for mounting said electrical switch by a fastener, having at least one groove or recess for mounting said electrical switch by a tie member and having at least one surface for mounting said electrical switch by an adhesive member, whereby actuating the contact member causes an electrical switch connection to be made between the first and second electrical conductors, and whereby said electrical switch may be mounted by any one or more of a fastener, a tie member, and an adhesive member.

10. The electrical switch of claim 9 wherein said mounting comprises first and second end members, wherein said first and second end members:

having the at least one hole for mounting said electrical switch, have the at least one groove or recess for mounting said electrical switch and have the at least one surface for mounting said electrical switch; or have respective raised surfaces that are a greater distance from the mounting surface of said mounting than is the electrically conductive contact member; or have the at least one hole for mounting said electrical switch, have the at least one groove or recess for mounting said electrical switch and have the at least one surface for mounting said electrical switch, and have respective raised surfaces that are a greater distance from the mounting surface of said mounting than is the electrically conductive contact member.

11. The electrical switch of claim 10 further comprising a flexible sheath enclosing said electrically conductive contact member, at least a portion of said first and second electrical conductors, and at least a portion of said first and second end members.

12. The electrical switch of claim 9 wherein said mounting comprises a front housing and a rear housing, said front housing having the at least one mounting hole and having the at least one groove or recess, and said rear housing having an at least one mounting hole aligned with the at least one mounting hole of said front housing and having the at least one mounting surface.

13. The electrical switch of claim 12 further comprising a shaped flexible cover covering said electrically conductive contact member, wherein said front housing has an opening exposing said shaped flexible cover.

14. The electrical switch of claim 13 wherein said shaped flexible cover includes a crown portion positioned over said electrically conductive contact member and exposed by the opening in said front housing and a brim portion retained between said front housing and said rear housing.

15. The electrical switch of claim 9:

wherein said mounting further includes an outwardly extending flange along at least two opposing edges thereof; or wherein said mounting has respective raised surfaces proximate opposing ends thereof that are a greater distance from the mounting surface of said mounting than is said electrically conductive contact member.

16. An electrical switch for making selective electrical connection between first and second electrical leads when actuating force or pressure is applied, comprising:

an elongate planar dielectric circuit board having a first electrical conductor extending in an elongated direction in a central region thereof, having a second electrical conductor extending in the elongated direction proximate an edge thereof, and having a given width between edges along the elongated direction, wherein the first and second electrical leads are respectively connected electrically to the first and second electrical conductors;

a flexible metal contact member having a plurality of flexible contact fingers extending between opposing continuous edges thereof, said flexible metal contact member being formed in a "C" shape with the continuous edges at the ends thereof spaced apart by about the given width and with the plurality of flexible contact fingers in an arcuate shape;

wherein said elongate planar dielectric circuit board is disposed within said flexible metal contact member with the continuous edges of said flexible metal contact member along the edges of said elongate dielectric circuit board, with the second electrical conductor permanently electrically connected to one of the continuous edges of said flexible metal contact member, and with the plurality of arcuate flexible contact fingers overlying the first electrical conductor for making electrical connection thereto when actuating force or pressure is applied thereto.

17. The electrical switch of claim 16 further comprising:

first and second end members attached to opposite ends of said elongate planar dielectric circuit board, wherein said first and second end members:

provide respective first and second mounting points for said electrical switch; or have respective raised surfaces that are a greater distance from said elongate planar dielectric circuit board than are the plurality of contact fingers of said flexible metal contact member; or provide respective first and second mounting points for said electrical switch and have respective raised surfaces that are a greater distance from said elongate planar dielectric circuit board than are the plurality of contact fingers of said flexible metal contact member.

18. The electrical switch of claim 17 wherein each of said first and second end members has a respective mounting hole for receiving a fastener, a respective transverse recess for receiving a tie member and a respective mounting surface for receiving an adhesive member.

19. The electrical switch of claim 17 further comprising a flexible sheath enclosing said elongate planar dielectric circuit board and said flexible metal contact member and at least a portion of said first and second end members, and conforming thereto.

20. The electrical switch of claim 17 wherein each of said first and second end members has a respective interlocking feature, and wherein said elongate planar dielectric circuit board has interlocking features corresponding to and interlocking with the interlocking features of said first and second end members.

21. The electrical switch of claim 16 further comprising a flexible sheath enclosing said elongate planar dielectric circuit board and said flexible metal contact member, and conforming thereto.

22. The electrical switch of claim 16 further comprising an electrically conductive member electrically connected to and on the first electrical conductor of said elongate planar dielectric circuit board, whereby deforming any one or more of the flexible contact fingers towards the elongate planar dielectric circuit board causes an electrical connection to be made between the first and second electrical conductors via the electrically conductive member.

23. An electrical switch comprising:

first and second end members each having a mounting surface suitable for mounting against an object and each having a raised portion opposing the mounting surface and spaced therefrom by a given dimension, thereby to define a height of each of said first and second end members;

a switch member extending between and attached to said first and second end members and having a flexible contact member defining a ridge extending in a direction from said first end member to said second end member, wherein the ridge of said flexible contact member will be spaced apart from the object by a distance less than the given dimension of said end members if and when said electrical switch is mounted against the object, thereby to define a height of said switch member, and an electrical conductor disposed within said switch member for being contacted by the flexible contact member when an actuating force is applied to deform said flexible contact member, whereby the actuating flexible contact member is disposed between the raised portions of said end members at a height that is less than the height of said first and second end members.

24. The electrical switch of claim 23 further comprising a flexible sheath enclosing said switch member and at least a portion of said first and second end members, and conforming thereto.

25. The electrical switch of claim 23 wherein said flexible contact member includes a plurality of adjacent formed contact fingers defining the ridge.

26. The electrical switch of claim 23 wherein said first and second end members each have a mounting hole for receiving a fastener, a transverse recess for receiving a tie member and a mounting surface for receiving an adhesive member.

27. An electrical switch comprising:

a dielectric substrate having a first electrical conductor disposed in a central region of a first surface thereof and having a second electrical conductor disposed on the first surface thereof adjacent the first electrical conductor thereof;

an arcuate flexible metal contact member juxtaposed to the first surface of said dielectric substrate, said arcuate flexible metal contact member having a substantially planar peripheral edge proximate and electrically connecting to the second electrical conductor of said dielectric substance and having a domed central region overlying the first electrical conductor of said dielectric substrate for making electrical contact therewith when actuating force or pressure is applied to said arcuate flexible metal contact member;

a shaped flexible cover juxtaposed to said arcuate flexible metal contact member at a surface thereof distal the first surface of said dietetic substrate, whereby said arcuate flexible metal contact member is between said shaped flexible cover and said dielectric substrate;

a housing having said dielectric substrate, said arcuate flexible metal member and said shaped flexible cover disposed therein, said housing having an opening exposing said shaped flexible cover, and said housing having a mounting hole for receiving a fastener, a transverse groove for receiving a tie member, a mounting surface for receiving an adhesive member, and outwardly extending flanges along at least two opposing edges thereof, whereby applying actuating force or pressure to deform the shaped flexible cover and the arcuate flexible metal contact member causes an electrical connection to be made between the first and second electrical conductors via the arcuate flexible metal contact member, and whereby said electrical switch is mountable to an object by any one or more of a fastener in the mounting hole, a tie member in the transverse groove, an adhesive member on the mounting surface and the outwardly extending flanges.

28. The electrical switch of claim 27 wherein said shaped flexible cover includes a crown portion positioned over said arcuate flexible metal contact member and exposed by the opening in said housing and a brim portion retained by said housing.

29. The electrical switch of claim 27 wherein said housing comprises a front housing and a rear housing, said front housing having the mounting hole and the transverse groove, and said rear housing having a mounting hole aligned with the mounting hole of said front housing, the mounting surface, and the outwardly extending flanges along at least two opposing edges thereof.

30. The electrical switch of claim 29 wherein said front and rear housings are joined together to retain said shaped flexible cover therebetween, wherein said front and rear housings are joined together by any one or more of adhesive, glue, welding, sonic welding, ultrasonic welding, heat welding, corresponding matching latching features for snap engagement, corresponding clasping features for snap engagement, fasteners, screws, and pins.

31. The electric switch for claim 27 further comprising an electrical cord including at least two electrical conductors that are electrically connected to the first and second electrical conductors of said dielectric substrate, whereby applying actuating force or pressure to said electrical switch causes an electrical connection to be made between the at least two second electrical conductors of said electrical cord.

* * * * *